United States Patent [19]

Carlson

[11] Patent Number: 4,608,787

[45] Date of Patent: Sep. 2, 1986

[54] MANHOLE SEAL CONSTRUCTION

[76] Inventor: Franklin J. Carlson, 1081 Wisconsin Ave., Okauchee, Wis. 53069

[21] Appl. No.: 624,453

[22] Filed: Jun. 25, 1984

[51] Int. Cl.[4] ..... E02D 29/14

[52] U.S. Cl. ..... 52/20; 404/25; 285/226

[58] Field of Search ..... 52/19, 20, 21, 393, 52/396, 400, 399; 404/24, 25; 285/226

[56] References Cited

U.S. PATENT DOCUMENTS

| | | | |
|---|---|---|---|
| 1,940,924 | 12/1933 | Taylor | 404/25 X |
| 3,629,981 | 12/1971 | McCaffery | 52/19 |
| 4,101,236 | 7/1978 | Meyer | 404/25 |
| 4,305,679 | 12/1981 | Modi | 52/20 X |
| 4,449,715 | 5/1984 | Gagas | 285/226 X |
| 4,469,467 | 9/1984 | Odill et al. | 52/20 X |
| 4,475,845 | 10/1984 | Odill et al. | 52/20 X |

*Primary Examiner*—William F. Pate, III
*Assistant Examiner*—C. Smith
*Attorney, Agent, or Firm*—Andrus, Sceales, Starke & Sawall

[57] ABSTRACT

A manhole seal construction adapted to engage the outer surface of the manhole frame and the chimney to seal the corbel joint from the outside and prevent leakage of water and entry of foreign material into the joint and manhole. A resilient ring having a hook-like upper section is engaged with the outwardly extending flange on the manhole frame, and the ring has a thin, stretchable central section which extends across the corbel joint. The lower portion of the ring terminates in a lower section having a series of internal ribs that seal against the chimney and having an outer circumferential groove to receive a clamping band. To provide additional sealing, an annular sealing gasket is bonded to the internal shoulder on the manhole frame and the manhole cover seats on the gasket to prevent leakage from the street into the manhole through the joint between the cover and the frame.

9 Claims, 5 Drawing Figures

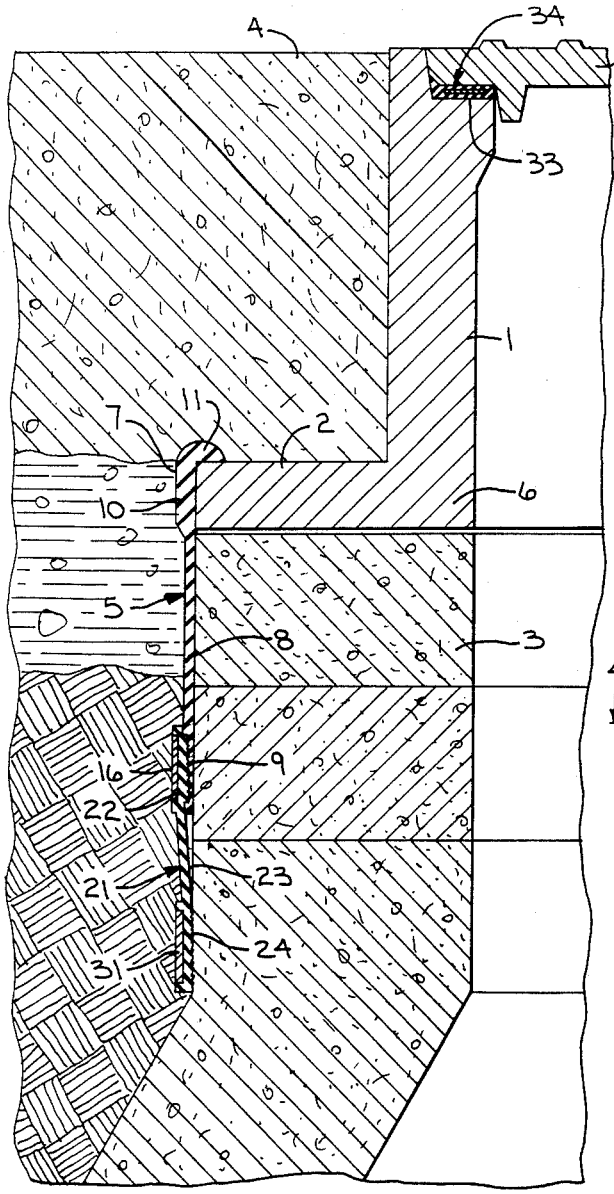
FIG. 1
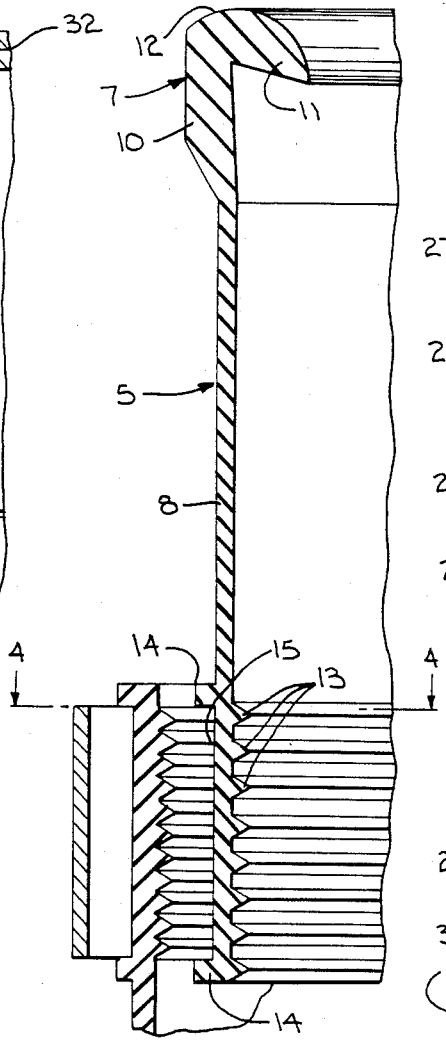
FIG. 2
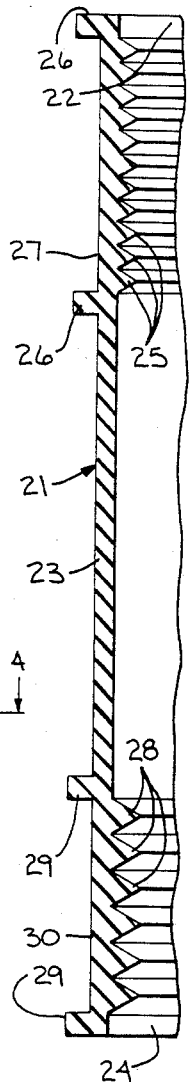
FIG. 3
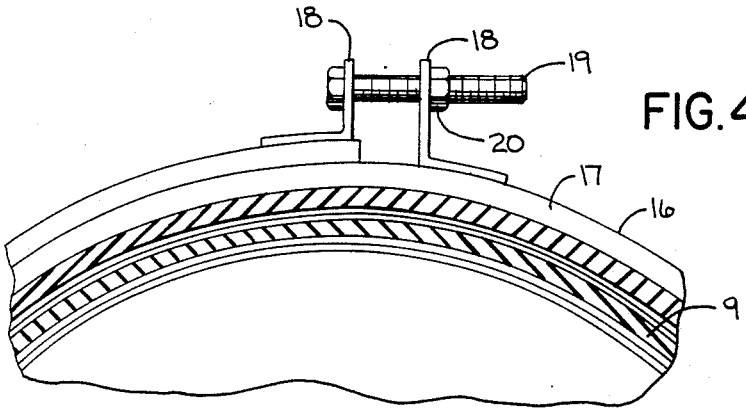
FIG. 4
FIG. 5
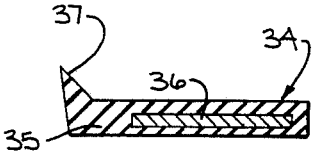

MANHOLE SEAL CONSTRUCTION

BACKGROUND OF THE INVENTION

The conventional manhole assembly includes a cast iron frame that defines the manhole and rests on a masonry chimney. The open upper end of the manhole frame is enclosed by a cast iron cover. There is a tendency for rainwater or melting snow to flow into the manhole through the corbel joint between the manhole frame and the chimney, as well as through the joint between the frame and the cover. This results in a substantial volume of water entering the sewage system through the manhole, particularly during periods of heavy rain, thereby overtaxing the municipal sewer system. Because of this, there have been attempts to seal the manhole to prevent leakage of water into the sewage system through the manhole.

One manner of preventing leakage into the manhole is disclosed in U.S. Pat. No. 4,305,679, in which a resilient ring is applied to the inner surface of the manhole frame and chimney and sealing bands clamp the ring against the frame and against the chimney on either side of the corbel joint. While sealing systems as disclosed in U.S. Pat. No. 4,305,679 prevent leakage of water into the manhole through the corbel joint, the internal seal does not prevent the entry of foreign material into the corbel joint which can cause possible misalignment of the manhole frame and cover with respect to the street or roadway. There is a tendency for the manhole frame to heave or lift due to frost, causing an enlargement of the corbel joint. Foreign material, such as sand, or other debris can lodge in the corbel joint preventing the frame from properly reseating. Not only does this increase the depth of the joint to promote greater leakage, but can cause improper alignment of the manhole frame and the cover with respect to the road surface.

SUMMARY OF THE INVENTION

The invention is directed to a manhole construction adapted to be connected to the outer surface of the manhole frame and chimney to seal the corbel joint from the outside and prevent leakage of water through the corbel joint, as well as preventing entry of foreign materials into the joint during frost heaving.

In accordance with the invention, the construction includes a resilient ring having a hook-like upper section which is engaged with the outwardly extending flange on the manhole frame. The ring includes a thin stretchable central section which extends across the corbel joint and terminates in a lower section having internal ribs that seal against the chimney and having an external groove to receive a clamping bank.

In a modified form of the invention, an extension ring can be attached to the lower end of the sealing ring to increase the overall height of the seal. The extension ring includes an upper portion having a series of internal ribs or serrations that are received within the groove in the lower section of the sealing ring, and the outer surface of the upper portion of the extension ring is provided with an external circumferential groove to receive a clamping band.

Extending downwardly from the upper portion of the extension ring is a central stretchable portion which terminates in a lower portion having a series of internal circumferential ribs that seal against the outer surface of the chimney. In addition, the lower portion of the extension ring is formed with an outer circumferential groove to receive a second clamping band.

As a further aspect of the invention, a resilient sealing gasket is bonded to the internal shoulder of the manhole frame and the peripheral edge of the cover seats against the sealing ring to prevent leakage of water into the manhole through the joint between the cover and the frame.

The manhole sealing construction of the invention prevents leakage of water through the corbel joint, as well as through the joint between the frame and the manhole cover. As the sealing ring is applied to the outer surface of the frame and the chimney it also prevents entry of foreign material into the corbel joint and maintains proper seating of the frame on the chimney.

As the central section of the sealing ring is stretchable, the ring will accommodate frost heaving and heat expansion and will aid in returning the frame to its proper seated position.

Other objects and advantages will appear in the course of the following description.

DESCRIPTION OF THE DRAWINGS

The drawings illustrate the best mode presently contemplated of carrying out the invention.

In the drawings:

FIG. 1 is a vertical section showing the manhole sealing construction of the invention;

FIG. 2 is a view showing the sealing ring and a portion of the extension ring in the unattached condition;

FIG. 3 is a vertical section showing the extension ring;

FIG. 4 is a fragmentary horizontal section showing the clamping ring; and

FIG. 5 is a horizontal section of the sealing gasket located between the cover and the manhole frame.

DESCRIPTION OF THE ILLUSTRATED EMBODIMENT

FIG. 1 shows a manhole frame 1 formed of cast iron having an outwardly extending flange 2 which is supported on a masonry chimney 3. As shown in FIG. 1, the upper surface of a street or roadway 4 is substantially flush with the upper edge of frame 2.

In accordance with the invention, a sealing ring 5 is employed to seal the corbel joint 6 between the lower surface of frame 1 and chimney 3. Sealing ring 5 is formed of a resilient material, such as rubber, and is formed with an upper hook-like section 7, a thin stretchable central section 8 and a lower clamping section 9.

Upper section 7 of ring 5 is provided with a vertical leg 10 and a horizontal leg 11. As shown in FIG. 2, before the ring is assembled with the frame, the lower surface of horizontal leg 11 extends downwardly at an acute angle. The acute angle between legs 10 and 11, as well as the thickened configuration of the upper section enables the hook-like upper section 7 to clamp against the upper surface of flange 2 without the tendency to creep around the corner when the ring is clamped to the chimney.

Horizontal leg 11 is provided with a generally curved upper surface 12 which acts to deflect foreign materials outwardly away from the sealing ring.

As best illustrated in FIG. 2, the lower clamping section 9 is provided with a plurality of parallel, circumferentially extending ribs or serrations 13 which engage the outer surface of the chimney, as shown in FIG. 1. The serrations provide an improved clamping engagement between the sealing ring 5 and the chimney 3. Extending outwardly from clamping section 9 are a pair of parallel ribs 14 which define a circumferential groove 15 that receives clamping band 16.

Clamping band 16 is a standard type including a flexible metal band 17, and a pair of angle brackets 18 extend outwardly from the band. A clamping bolt 19 extends through aligned openings in brackets 18 and receives a nut 20. By threading down of nut 20, the clamping band 16 will firmly clamp the sealing ring 5 to the chimney 3.

In certain installations where greater depth of sealing is required, a lower extension ring 21 can be connected to the lower section 9 of ring 5. As best illustrated in FIG. 3, the extension ring includes an upper portion 22, a central stretchable section 23 and a lower portion 24.

The inner surface of upper portion 22 is formed with a series of parallel circumferential ribs or serrations 25 which are adapted to be received within the groove 15 of sealing ring 5. In addition, the outer surface of the upper portion is provided with a pair of spaced circumferential ribs 26 which border groove 27 and clamping band 16 is received within groove 27 to bond both the lower section 9 of sealing ring 5 and upper portion 22 of extension ring 21 to the chimney 3.

Lower portion 24 of extension ring 21 is similarly formed with a plurality of circumferential ribs or serrations 28 which engage the outer surface of chimney 3, while the outer surface of lower portion 24 has a pair of parallel ribs 29 that define a groove 30 that receives clamping band 31, similar in construction to clamping band 16.

As previously mentioned, sealing ring 5 serves to seal the corbel joint 6 and not only prevents water from passing through the joint into the manhole, but also prevents foreign material, such as sand, gravel and the like from entering the corbel joint during periods when the frame may have heaved due to frost. As entry of foreign material into the joint is prevented, the frame will properly reseat on the chimney after the frost conditions have terminated.

The central stretchable section 8 permits the seal to accommodate frost heaving and heat expansion of the frame, while maintaining the seal of the corbel joint.

In certain installations, where a greater depth of seal is required, the extension ring 21 can be attached to the lower section 9 of sealing ring 5.

As another aspect of the invention, the manhole cover 32 is sealed to the internal shoulder or ledge 33 on manhole frame 1 by sealing gasket 34. Gasket 34 is bonded by a suitable adhesive to the upper surface of shoulder 33.

Sealing gasket 34 includes a body portion 35 having a generally flat metal ring 36 embedded therein, as shown in FIG. 5. The outer peripheral edge of the gasket 34 is formed with an upwardly extending lip 37 which is adapted to extend between the frame 1 and the chamfered lower edge of the cover. Gasket 34 not only prevents leakage of water through the joint between the cover 32 and frame 1, but also serves to cushion the cover and prevent rattling of the cover due to vehicle traffic. The metal ring 36 serves to prevent cutting or other damage to the gasket when the cover 31 is removed. The cover is normally removed by inserting a pick into one of the vent holes in the cover, causing the cover to tilt or pivot upwardly on shoulder 33. Ring 36 aids in preventing damage to gasket 34 during this tilting action.

In addition, it is contemplated that the vent holes in the cover can be plugged to prevent the flow of water through the vent holes into the manhole.

The seal construction of the invention can be utilized with new manhole constructions, as well as with existing constructions. With existing constructions it is necessary to remove the backfill material around the frame and chimney in order that the seal can be applied.

Various modes of carrying out the invention are contemplated as being within the scope of the following claims particularly pointing out and distinctly claiming the subject matter which is regarded as the invention.

I claim:

1. A manhole sealing assembly, comprising a manhole frame defining a manhole and having an outwardly extending flange and having a lower surface, a chimney having an upper surface to support said frame and having an outer peripheral surface disposed generally flush with the outer periphery of said flange, said flange being directly supported on the upper surface of said chimney and said upper and lower surfaces having a joint therebetween, a resilient sealing ring disposed along the outer periphery of said flange and along the outer surface of said chimney and extending across said joint, said sealing ring including an upper hook-like section composed of a vertical leg and a single generally horizontal leg extending radially inward from said vertical leg, the included angle between said legs being an acute angle when the sealing ring is unattached to said frame, said generally horizontal leg being disposed in engagement with the upper surface of said flange, said sealing ring also including a central stretchable section and having a lower clamping section, and clamping means for clamping said lower section to the outer surface of said chimney, said central section being in a taut condition and relative movement between said flange and chimney causing said central section to stretch to maintain said horizontal leg in sealing engagement with said flange.

2. The assembly of claim 1, and including an extension ring disposed in engagement with the outer surface of said chimney, said extension ring including an upper portion disposed in lapping relation with the lower section of said sealing ring, said clamping means disposed to clamp said upper portion and said lower section against said chimney, said extension ring also including a central portion and a lower portion, and second clamping means for clamping said lower portion against the outer surface of said chimney.

3. The assembly of claim 2, wherein the outer surfaces of the upper and lower portions of said extension ring have circumferential recesses to receive the respective clamping means.

4. The assembly of claim 2, wherein the inner surface of said upper portion is provided with a plurality of parallel circumferentially extending ribs, said ribs being disposed within a groove in said lower section.

5. The assembly of claim 1, wherein said central section has a lesser thickness than said upper section.

6. The assembly of claim 1, and including an annular shoulder disposed on the inner surface of said frame adjacent the upper end of said frame, a manhole cover supported on said shoulder, an annular resilient sealing gasket disposed between said shoulder and the peripheral edge of said cover to seal the joint therebetween, and a relatively thin metal ring embedded in said gasket.

7. the assembly of claim 6, wherein the outer peripheral edge of said annular sealing gasket is provided with an upwardly extending tapered tip.

8. The assembly of claim 1, and including a plurality of circumferentially extending ribs formed on the inner surface of said clamping section and disposed in engagement with the outer surface of said chimney.

9. The assemlby of claim 1, wherein said central section is generally cylindrical in shape and is free of circumferential corrugations.

* * * * *